United States Patent [19]

Smith et al.

[11] Patent Number: 4,687,067

[45] Date of Patent: Aug. 18, 1987

[54] CROSSFLOW ROTARY CONE ROCK BIT WITH EXTENDED NOZZLES

[75] Inventors: Richard D. Smith, Lakewood, Calif.; Michael S. Oliver, Lafayette, La.; Richard D. Crouse, Huntington Beach; Weng-Kwen R. Chia, Irvine, both of Calif.

[73] Assignee: Smith International, Inc., Newport Beach, Calif.

[21] Appl. No.: 858,487

[22] Filed: May 1, 1986

[51] Int. Cl.[4] ..... E21B 10/18

[52] U.S. Cl. ..... 175/340; 175/424

[58] Field of Search ..... 175/339, 340, 393, 422 R, 175/65, 67; 299/81; 166/222, 223

[56] References Cited

U.S. PATENT DOCUMENTS

| | | | |
|---|---|---|---|
| 2,045,368 | 6/1936 | Reed . | |
| 2,124,521 | 7/1938 | Williams et al. . | |
| 2,815,936 | 12/1957 | Peter et al. . | |
| 2,950,090 | 8/1960 | Swart | 175/340 |
| 3,096,834 | 7/1963 | Steen . | |
| 3,363,706 | 1/1968 | Feenstra . | |
| 3,509,952 | 5/1970 | Galle . | |
| 3,823,789 | 7/1974 | Garner . | |
| 4,077,482 | 3/1978 | Ioannesian et al. | 175/340 |
| 4,106,577 | 8/1978 | Summers . | |
| 4,126,194 | 11/1978 | Evans . | |
| 4,187,921 | 2/1980 | Garner . | |
| 4,189,014 | 2/1980 | Allen et al. . | |
| 4,285,409 | 8/1981 | Allen | 175/339 X |
| 4,301,877 | 11/1981 | Cloud | 175/340 |
| 4,369,849 | 1/1983 | Parrish . | |
| 4,400,024 | 8/1983 | Ratcliff et al. | 175/340 X |
| 4,516,642 | 5/1985 | Childers et al. . | |
| 4,542,798 | 9/1985 | Madigan | 175/393 X |
| 4,567,954 | 2/1986 | Voight, III et al. | 175/422 R |

FOREIGN PATENT DOCUMENTS

| | | | |
|---|---|---|---|
| 2606712 | 8/1976 | Fed. Rep. of Germany | 175/340 |
| 258972 | 10/1970 | U.S.S.R. | 175/339 |
| 0861536 | 9/1981 | U.S.S.R. | 175/340 |
| 1048104 | 10/1983 | U.S.S.R. | 175/339 |

*Primary Examiner*—Stephen J. Novosad
*Assistant Examiner*—David J. Bagnell
*Attorney, Agent, or Firm*—Robert G. Upton

[57] ABSTRACT

A three cone rock bit is disclosed having at least a pair of mini-extended nozzles extending from a dome portion of the bit. Two 120° leg segments contain extended nozzles, a third 120° segment is nozzleless. The mini-extended nozzles convert hydraulic pressure to kinetic fluid flow energy with a minimum of flow disturbance, thereby delivering a concentrated flow of fluid against the floor of the formation and across the cutting face of the bit, sweeping detritus past the nozzleless 120° leg segment and up the borehole. A centerjet mini-extended nozzle may additionally be positioned in the rock bit dome to further enhance borehole penetration.

9 Claims, 7 Drawing Figures

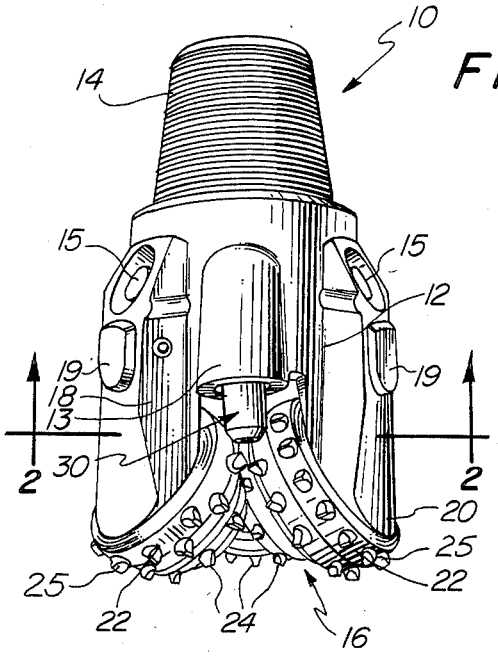
FIG. 1
FIG. 2
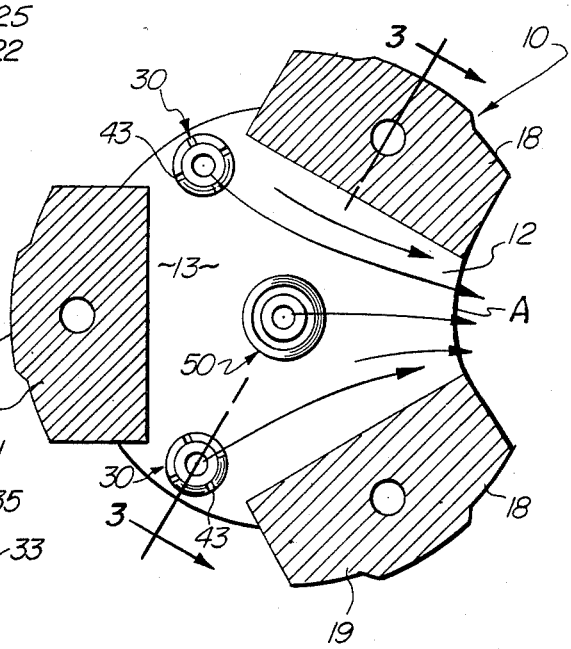
FIG. 3
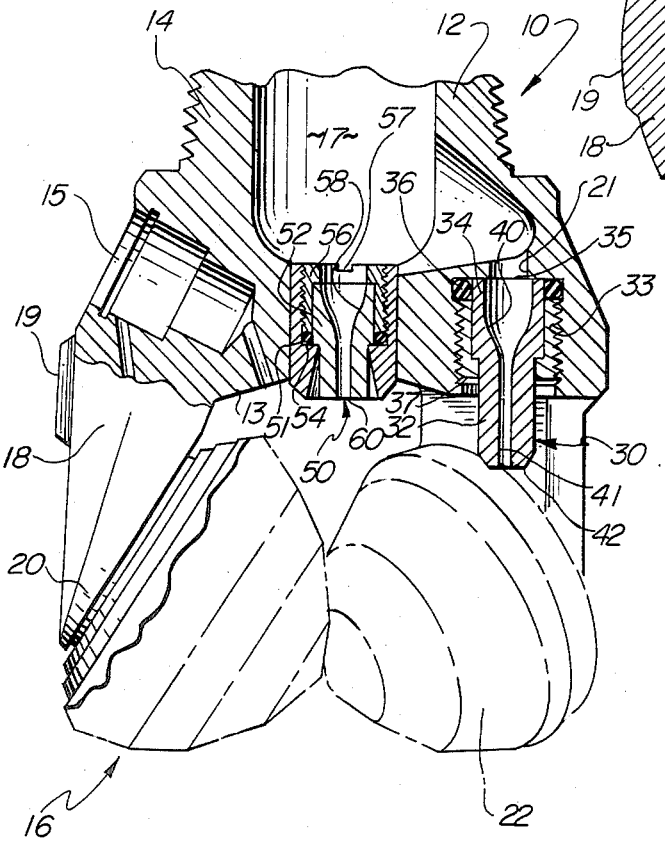

CROSSFLOW ROTARY CONE ROCK BIT WITH EXTENDED NOZZLES

BACKGROUND OF THE INVENTION

1. Field of the Invention

This invention relates to rotary cone rock bits of the type that operate in hydraulic fluid or "mud".

More particularly, this invention relates to three cone rock bits having easily interchangeable, partially extended hydraulic nozzles protruding from two of the three 120° leg segments that comprise the body of the rock bit. The third 120° leg segment is devoid of a nozzle, hence fluid exiting from the two mini-extended nozzles will cross the cutting face of the bit, sweeping detritus from the borehole bottom and up the previously drilled borehole shaft.

2. Description of the Prior Art

There is much prior art that deals with fluid flow through a rock bit. One of the major problem areas in rock bit penetration is the removal of formation cuttings from a borehole so that the cutting end of the bit attacks new formation and not old cuttings.

Conventional nozzles generally lack sufficient flow velocity or hydraulic power to sweep the hole bottom of detritus. Fluid from conventional nozzles, released adjacent to the dome area of a rotary cone rock bit, entraps detritus-laden fluid near the dome and forces the cuttings back under the cones where they are reground, thus inhibiting the penetration rate of the rock bit during drilling operations.

The following patents all teach the use of higher fluid flow velocities to enhance rotary cone drill bit operations.

U.S. Pat. No. 2,815,936 utilizes a pair of oppositely opposed nozzles extending from a dome area formed by the bit body to direct fluid between the pair of cones and against the borehole bottom. A pair of low velocity nozzles are directed at the cutter cones to clean the debris from the cutting surface.

U.S. Pat. Nos. 3,363,706 and 3,509,952 both teach extended nozzles, emanating from the dome area, having their exit plane just above the borehole bottom. Three extended nozzles pass between three cutter cones to direct fluid at the borehole bottom.

U.S. Pat. No. 4,106,577 combines a centrally positioned high pressure water jet drill with rotary cutter cones to facilitate formation penetration. Multiple apertures in the end of the injector head of the central jet direct fluid in different directions to enhance bit penetration.

The foregoing patents, while they attempt to more efficiently utilize hydraulic action to enhance formation drilling, fail to remove the detritus from the borehole bottom in an expeditious manner, resulting in regrinding of the cuttings before they can be moved from the borehole bottom.

U.S. Pat. Nos. 4,126,194; 4,187,921 and 4,189,014 are assigned to the same assignee as the present invention. These patents generally teach sweeping the bottom of a formation to remove detritus therefrom. The '194 patent teaches the use of two nozzles, one each in 120° leg segments, the third 120° leg segment having a funnel-type pickup tube axially aligned with the rock bit body, an inlet end of the tube being positioned just above the borehole bottom. The idea is to sweep formation cuttings across the borehole bottom and up the pickup tube. While this invention has considerable merit, the pickup tube lacks sufficient size to handle a large volume of cuttings.

The '921 patent utilizes opposed extended nozzles in a two rotary cone rock bit. Crossflow of hydraulic fluid is generated by cavitating one of the two opposed nozzles. The pressure differential between the two nozzles encourages crossflow, thereby sweeping the borehole bottom during rock bit operation.

The '014 patent was designed to enhance crossflow of drilling fluid. Two nozzles, one each in 120° leg segments, are mounted slightly extended from the dome portion of the bit. Each nozzle is sealed on the gage side of the 120° leg segment to assure crossflow of fluid toward the remaining, nozzleless 120° leg segment. The last mentioned segment is open to the borehole annulus for passage of rock bit cuttings. A flow diverter is mounted in the center of the dome to decrease the dome area, thereby increasing the flow velocity around the diverter and across the bit face. The diverter also serves to discourage the accumulation of formation cuttings that tend to "ball up" in the center of the bit.

The present invention is a vast improvement over the '014 patent in that flow velocities are increased dramatically and flow patterns are established around the cutter cones to ensure expeditious removal of detritus away from the cutting end of the rock bit, thereby obviating the need of a dome flow diverter and "sealed" nozzle area during operation of the bit in an earthen formation.

Finally, U.S. Pat. Nos. 4,369,849 and 4,516,642 attempt to direct fluid flow in such a manner as to move detritus from the borehole bottom. The '849 patent utilizes multiple nozzles at various angles with respect to the axis of the rock bit. The nozzles are also positioned in the dome area in a spiral pattern. The spiral nozzle configuration attempts to create a spiral flow path of fluid on the borehole bottom.

The '642 patent teaches directing a stream of fluid through a nozzle at the leading cutting edge of a rotary cutter cone to both clean the teeth of the cone and to move cuttings away from the advancing roller cone. In a multiple cone bit, each cone has its own nozzle. The nozzle is canted or angled toward the leading edge of the rotary cone to clean the cutting elements extending from the cone surface. The cuttings, however, tend to circulate on bottom due to the nozzles being circumferentially symmetrically spaced around the rock bit body where three cone bits are utilized.

Borehole cuttings tend to adhere or "stick" to the bottom of a borehole due to hydraulic pressures from the drilling fluid being pumped down the drillstring from the floor of the drilling rig. It requires a great deal of agitation to force the detritus adhering to the borehole bottom up the annulus formed between the drillstring and the borehole to prevent the cutting end of a drill bit from regrinding or recutting this debris.

The present invention is primarily directed to accelerate the removal of detritus from the bottom of a borehole, thereby enhancing rock bit penetration.

The use of mini-extended nozzles with special nozzle profiles to accelerate hydraulic fluid therethrough and a nozzleless 120° leg segment to create crossflow of fluid over the borehole bottom assures removal of borehole cuttings therefrom.

A centerjet, which employs either a converging or diverging internal flow passage, may be employed to further encourage removal of detritus during drilling operations.

SUMMARY OF THE INVENTION

It is an object of this invention to provide a means to expeditiously remove cuttings from the bottom of a borehole during drilling operations.

More specifically, it is an object of this invention to provide at least a pair of mini-extended nozzles, one each in 120° leg segments, to accelerate fluid therethrough and across the cutting face of a drill bit during drilling operations.

A rotary cone rock bit is disclosed for use in drilling earthen formations, the drill bit being of the type that utilizes hydraulic mud to facilitate drilling operations. The body of the drill bit forms a chamber, the body having a first pin end adapted to be threadably connected to a drillstring. A sebond end of the bit body comprises a cutting end consisting of three rotary cones that are rotatively secured to three journal bearings extending from three 120° leg segments that connect to a dome portion of the bit body.

There are one or more mini-extended nozzles connected to the dome of the bit body. The nozzles are in fluid communication with the chamber formed by the bit body. The nozzles are so positioned in the dome portion to direct hydraulic fluid across the cutting end of the drill bit. The mini-extended nozzles are of sufficient length to displace the orifice of fluid discharge away from the dome portion, thereby creating an area of lower pressure to allow detritus to escape the dome area into the borehole without being entrained into the flow of newly discharged drilling fluid.

The nozzle internal profile formed by the mini-extended nozzles is adapted to accelerate drilling fluid therethrough to sweep cuttings or detritus from the bottom of the borehole that is drilled in the earth formation, thus enhancing drill bit penetration during drilling operations.

More specifically, the rotary cone rock bit is fabricated from three 120° leg segments which make up the body and leg portion of the drill bit. Two of the three 120° leg segments have mini-extended nozzles protruding from a dome portion of each individual leg segment. The third 120° leg segment is devoid of a nozzle. Thus, when the bit is fabricated by, for example, welding the three leg segments together, two of the three 120° leg segments contain threaded nozzle openings which will accept mini-extended nozzles. The third leg segment does not have provisions for a nozzle, hence fluid flow is directed across the cutting face of the bit, thereby sweeping cuttings past the nozzleless leg segment and up the borehole.

The mini-extended nozzle is further refined by the material of construction and geometry of the internal passage. For example, with nozzle construction from a hard, erosion resistant material, such as tungsten carbide, an opening is provided through the nozzle that is straight from a streamlined throat portion near an inlet portion of the nozzle toward an exit end of the nozzle. When nozzle construction is of an air hardening alloy steel with a secondary alloying process, such as "Diffusion Alloying", the opening through the nozzle is tapered from a streamlined throat portion near an inlet portion of the nozzle toward an exit end of the nozzle. The streamlined nozzle throat helps to accelerate the hydraulic fluid therethrough, thus providing fluid at great force against the borehole bottom. The interior nozzle profile minimizes cavitation and pressure losses associated with the extended portion of the mini-extended nozzle. The accelerated fluid flow lifts the cuttings from the bottom and sweeps them across the bit face and up the borehole.

An advantage then of the present invention over the prior art is the ability to accelerate hydraulic fluid through a pair of especially designed mini-extended nozzles to sweep cuttings from the borehole.

Yet another advantage over the prior art is the ability to position the mini-extended nozzles on one side of the bit so that fluid is forced across the cutting face of the bit during operation.

Another advantage of the present invention over the prior art is positioning the exit end of the mini-extended nozzles closer to the borehole bottom to direct an accelerated stream of fluid against the bottom for better cleaning action.

Still another advantage of the instant invention over the prior art is the creation of an area of relatively slow moving fluid adjacent the dome area which allows detritus to move from the dome area of the bit body to the outer circumference of the bit body and up the previously drilled borehole without being entrained into the flow of newly discharged fluid and introduced back below the cutter cones.

Yet another advantage of this invention over the prior art is the ability to utilize less wear resistant, less expensive and more easily manufactured materials of construction with the ability to tailor the internal flow passage of the mini-extended nozzle to minimize cavitation and wear forces.

The above noted objects and advantages of the present invention will be more fully understood upon a study of the following description in conjunction with the detailed drawings.

BRIEF DESCRIPTION OF THE DRAWINGS

FIG. 1 is a perspective view of a sealed bearing rotary cone rock bit, illustrating mini-extended nozzles extending from a dome portion of the bit;

FIG. 2 is a partially cutaway cross section taken through 2—2 of FIG. 1, illustrating the crossflow of fluid past the cutting end of the bit;

FIG. 3 is a partially cutaway cross section taken through 3—3 of FIG. 2, illustrating the centerjet and one of the mini-extended nozzles;

Figure 4:
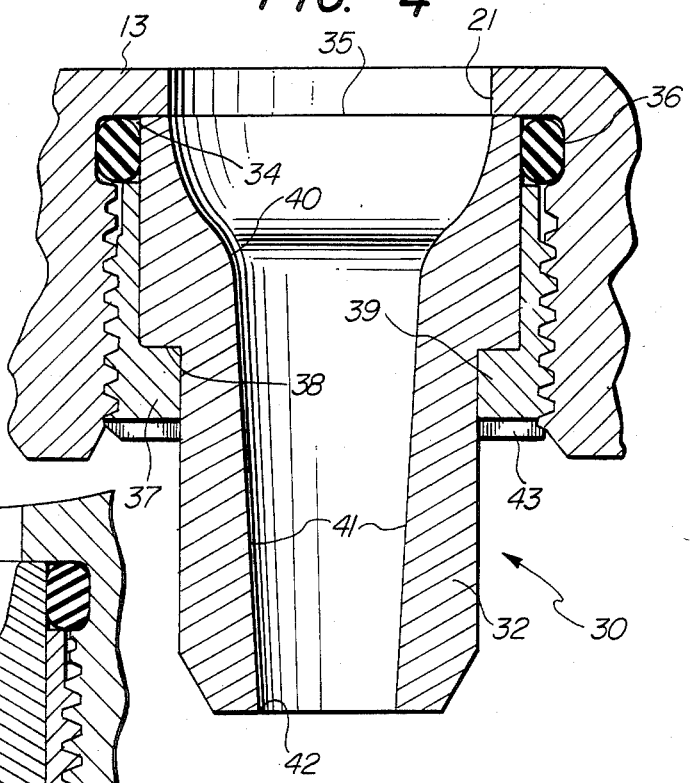
FIG. 4 is an enlarged cross section of a mini-extended nozzle.

DESCRIPTION OF THE PREFERRED EMBODIMENTS AND BEST MODE FOR CARRYING OUT THE INVENTION

With reference to the prior art figure, a standard nozzle body 2 is shown seated within a nozzle opening 5 formed in a dome portion 3 of a rock bit. The nozzle is secured within the nozzle opening 5 by threaded nozzle retainer 4. An O-ring 6 prevents leakage between the interior of a rock bit body and the threaded retainer 4.

Turning now to FIG. 1, the rotary cone rock bit, generally designated as 10, consists of rock bit body 12, pin end 14 and a cutting end, generally designated as 16. The cutting end consists of rotatable cutter cones 22 that are attached to a leg portion 18 near shirttail 20. Each of the cones 22 has, for example, a multiplicity of cutter inserts 24 retained by the cone 22.

It would be obvious to utilize other cutting structure, such as milled teeth, formed in each of the cones 22. It would additionally be obvious to utilize the principles set forth in this invention on sealed and non-sealed rotary cone rock bits (not shown).

A mini-extended nozzle, generally designated as 30, is shown protruding from a dome portion 13 of bit body 12. Each leg 18, for example, supports stabilizer lugs 19 secured to the exterior of the leg and serves to maintain the gage or diameter of the borehole, as well as, in conjunction with the gage inserts 25, form a two-point bridge to protect the shirttail from contacting the sides of the borehole.

FIG. 2 illustrates a pair of mini-extended nozzles, generally designated as 30, positioned within a dome portion 13 of bit body 12. A centerjet, generally designated as 50, is positioned centrally of the dome 13. During operation of the bit, as the bit rotates, hydraulic fluid is accelerated through the mini-extended nozzles and crosses the dome of the bit and exits past the dome face 13 through a section A of the bit that does not have a nozzle. Fluid exiting the centerjet 50 is diverted past the nozzleless section A and serves to prevent "balling" of the cuttings in the center of the bit above the cones 22.

FIG. 3 shows the relationship of the centerjet 50 with the mini-extended nozzles 30. The rock bit body 12 forms an inner hydraulic chamber 17 which communicates both with the centerjet 50 and the mini-extended nozzles 30. Fluid enters pin end 14 of bit body 12 and is diverted toward the mini-extended nozzles 30 through passage 21. The fluid then enters the base end 35 of nozzle body 32. The fluid is accelerated through streamlined throat portion 40, down passage 41 and out through exit 42 at the end of the extended nozzle body 32. The exterior of the nozzle body 32 forms a shoulder 38 which is designed to accept a threaded nozzle retainer 37. The nozzle retainer 37 forms a flange 39 that mates against shoulder 38 as the nozzle retainer 37 is threaded into the nozzle retention cavity 34. An O-ring 36 surrounds the base end 35 of the nozzle body 32 and serves to prevent hydraulic fluid from being diverted past the end 35 of nozzle body 32 and out through the area formed between the threaded retainer 37 and the nozzle receptacle 34. The nozzle retainer 37 is installed by a special tool (not shown) that engages slots 43 in the end of threaded retainer 37.

FIG. 4 illustrates in greater detail the mini-extended nozzle 30. This view clearly shows the streamlined throat portion 40 of nozzle body 32 which transitions into tapered walls 41 of the lower portion of the extended nozzle body 32. The tapered walls form an included angle between one and five degrees. In any case, the included angle of the taper is no less than one degree. The tapered walls 41 are necessitated by the use of, for example, alloy steel in the fabrication of the mini-extended nozzle 32. These walls could be straight when a material such as tungsten carbide is utilized for nozzle fabrication. Nozzle body 32 terminates at nozzle exit 42. The flange 39 of the threaded retainer 37 seats against shoulder 38 of nozzle body 32, securing the nozzle against the dome portion 34 at nozzle opening 35. The O-ring 36 surrounds nozzle base opening 35 and forms a seal between the base 35 and the dome portion 13. Notches 43 are, for example, formed on the nozzle retainer so that the retainer may be screwed into the threaded opening 34 by a tool (not shown) to securely retain the mini-extended nozzle to the dome 13 of the bit 10.

The interior shape of the streamlined mini-extended nozzle is especially designed to accelerate fluid through the nozzle body 32. It is also designed to compensate for any pressure losses due to the extended portion of the nozzle body 32.

The total impact value of a fluid jet stream exiting from a nozzle of a rock bit decreases with increasing distance from the nozzle exit to the borehole bottom. The fluid stream velocity is further decreased with increasing distance between exit plane and borehole bottom when confined by the well bore.

For example, for a nozzle body having an inside bore diameter of 10/32 of an inch on a rock bit having a gage or diameter of $7\frac{7}{8}$ of an inch, the mini-extended nozzle exit plane is, for example, $3\frac{1}{2}$ inches from the bottom of the borehole. This compares with 5 inches measured from the exit plane of a standard nozzle such as that illustrated in the prior art figure. The fluid impact energy along the centerline of the fluid stream exiting from the mini-extended nozzle, will be increased by 30 percent at the target area of the borehole bottom.

Since the mini-extended nozzle is longer in length than the standard nozzle, the total hydraulic energy loss through the extended nozzle increases along with the extension. Therefore, it is important to streamline the nozzle profile to reduce the energy loss caused by the additional length of the nozzle to a minimum and to focus the jet stream of the exit plane to a maximum. This objective can be achieved by carefully shaping the nozzle profile.

Figure 7:
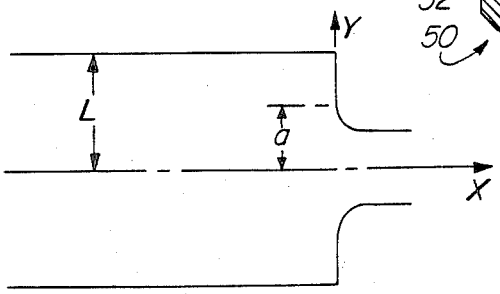
FIG. 7 is a schematic of a nozzle profile and is used to determine the mathematical equations to achieve optimum flow rates with a minimum of turbulence.

A schematically-illustrated vessel, shown in FIG. 7, illustrates a flow pattern with a width of 2L, through a symmetric opening of width **2*a*** near the exit plane of the vessel. The fluid streamline can be mathematically expressed by the following equations.

$$\chi + yi = \frac{Q}{\pi V_o} \quad \frac{dt}{t^{\frac{1}{2}}}\left[\frac{1}{t-h} + \frac{1}{t-\frac{1}{h}} - \frac{2}{t-1}\right]$$

in which $-1<t<1$
$Q$=flow rate
$V_o$=velocity at the exit plane and,
h can be obtained from $$\frac{a}{L} = h^{\frac{1}{2}}\left[\frac{2}{\pi}\left(\frac{1}{h^{\frac{1}{2}}} - h^{\frac{1}{2}}\right) \tan^{-1} h^{\frac{1}{2}} + 1\right]$$

The foregoing mathematical equations are very complicated. Through experimentation, the nozzle profile was approximated to simulate a "natural" profile. This was done by using a large radius to form the internal passage of the nozzle. The pressure drop calculated from a viscous fluid computer code as almost the same as that from a standard (and shorter) nozzle (prior art illustration). The discharge coefficient of this design stays the same as the standard one during a hydraulic test. During actual mini-extended nozzle tests of a nozzle with the foregoing streamlined nozzle profile, it was found that the nozzle was much "quieter". This mode of operation indicates that the flow is less turbulent during the hydraulic test, hence less separation or cavitation at the exit plane of the nozzle and down the stream.

Figure 5:
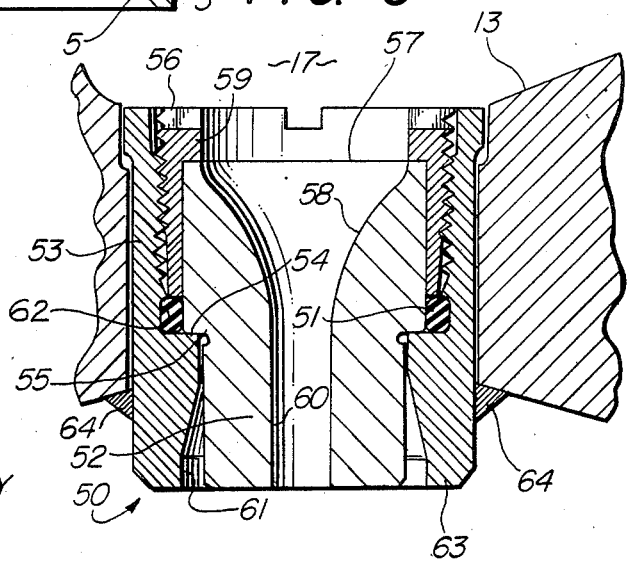
FIG. 5 is an enlarged cross section of a centerjet positioned in the center of the dome portion of the rock bit.

The centerjet 50, shown in FIGS. 3 and 5, is of slightly different configuration than the mini-extended nozzle 30 because of the placement of a retainer 56 and the utilization of a nozzle receptacle 53. The centerjet body 52 is inserted through pin end 14 of bit body 12. The nozzle body 52 drops into a nozzle receptacle 53 which is, for example, welded into the dome 13 at junction 64. The nozzle receptacle 53 is threaded at its upper end, the threaded portion terminating in an elongated flange 54. A nozzle retainer 56 forms a flange 59 (FIG. 5) to secure the nozzle base 57 against flange 54 of nozzle receptacle 53. An O-ring 51 forms a seal between the exterior portion of the nozzle body 52 and the nozzle receptacle 53 to prevent fluid from washing out the threaded retainer 56 during operation of the bit in a borehole. The exit end 60 of nozzle body 52 extends all the way to the end 63 of nozzle receptacle 53. The interior of the nozzle body 52 forms a throat portion 58 that transitions toward exit 60 of the nozzle body 52. By extending the end 60 of the nozzle body 52 to the exit 63 of receptacle 53, erosion is eliminated between the nozzle body 52 and the receptacle 53.

Figure 6:
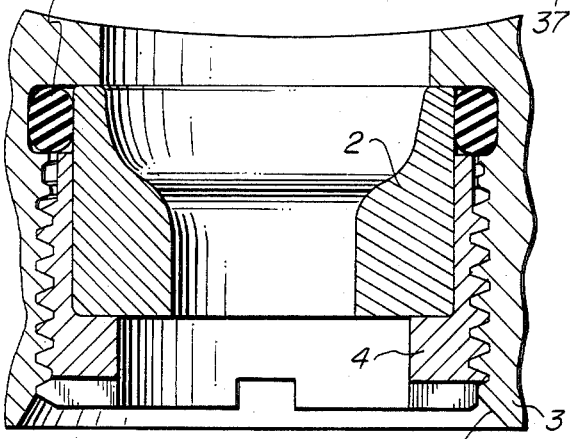
FIG. 6 Prior Art
FIG. 6 is labeled PRIOR ART and represents state of the technology.

With reference now to the prior art of FIG. 6, it is readily apparent that the nozzle body 2 terminates well within the nozzle retainer 4 and erosion can easily occur between the exits of the prior art nozzle and the nozzle retainer 4. This configuration may easily result in catastrophic ejection of the prior art nozzle from the dome of the bit.

The centerjet 50 primarily functions to prevent balling of the bit in the center of the dome portion 13.

FIG. 5 illustrates an enlarged centerjet showing the method in which the centerjet is installed into the dome portion through the pin end 14 of the bit 10 (FIG. 3). The centerjet nozzle 52 is inserted through receptacle 53 after O-ring 51 is positioned into receptacle groove 66 below truncated threads. The nozzle retainer 56 is then screwed into the receptacle 53, securing the nozzle body 52 into the receptacle. FIG. 5 further illustrates a straight bore from the streamlined nozzle 58 to nozzle exit 60 which could be utilized when a material such as tungsten carbide is used to fabricate the nozzle body 52.

In operation, hydraulic fluid or mud enters chamber 17 and is accelerated through a pair of mini-extended nozzles 30 and through the centerjet 50. Accelerated fluid through the especially designed inward passages 40 and 41 within the mini-extended nozzles 30 sweeps detritus from the borehole bottom across the cutting end of the bit. The rock chips then pass through the nozzleless section of the bit and up the borehole. As stated before, the centerjet 50 contributes to the flow of fluid sweeping across the cutting face of the bit and helps to prevent balling of the bit during rock bit operations.

Fluid and detritus which does not exit the cutting end of the bit by way of the nozzleless section are allowed passage up the borehole by passing by the small external diameter of the mini-extended nozzle. The area defined by the dome of the bit and the exit plane of the nozzles allow passage of the detritus without being entrained into the nozzle discharge fluid and forced below the cone cutters and recut.

The mini-extended nozzle may be further refined by the material of construction and geometry of the internal passage. For example, with nozzle construction from a hard, erosion resistant material, such as tungsten carbide, an opening is provided through the nozzle that is straight from a streamlined throat portion near an inlet portion of the nozzle toward an exit end of the nozzle (FIG. 5). When nozzle construction is of an air hardening alloy steel with a secondary alloying process, such as "Diffusion Alloying", the opening through the nozzle is tapered from a streamlined throat portion near an inlet portion of the nozzle toward an exit end of the nozzle (FIG. 4).

It would be obvious to utilize less wear resistant, less expensive and more easily manufactured materials of construction with the ability to tailor the internal flow passage of the mini-extended nozzle to minimize cavitation and wear forces.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A rotary cone rock bit for use in an earth formation, the rock bit being run with hydraulic fluid, the rock bit comprising:

a rock bit body having a first open pin end adapted to be connected to a drillstring and a second cutting end, said second cutting end consisting of three rotary cones rotatively retained on journal bearings extending from three 120° rock bit leg segments connected to a dome portion formed by said bit body, said bit body further forming a chamber therein for receiving said hydraulic fluid, said chamber is in fluid communication with said first open pin end; and a pair of mini-extended nozzles, each of said nozzles forming a first entrance end and a second exit end, said nozzles are connected to a dome portion formed by said bit body, said first entrance end of each of said nozzles being in fluid communication with said chamber, each mini-extended nozzle is positioned in said dome portion of said rock bit between two of the three 120° leg segments to direct said hydraulic fluid across said cutting end of said rock bit, a nozzle passage profile formed by each of said mini-extended nozzles define a streamlined entry transition sat said first nozzle entrance end from said dome portion to said entrance end, and a streamlined nozzle throat portion nearest said first nozzle entrance end, said passage further extends from said streamlined throat portion to said second nozzle exit end, said nozzle passage profile is adapted to accelerate hydraulic fluid therethrough to lift cuttings from a bottom of a borehole sweeping said cuttings across said second cutting end and to minimize cavitation and pressure losses associated with the extended portion of each of said mini-extended nozzles, said pair of mini-extended nozzles have sufficient length to create an area of low energy hydraulic fluid bounded on one side by said rock bit dome and limited by a plane established by the discharge fluid from an end of said nozzles, allowing free movement of detritus from said dome to a borehole cut by said rock bit.

2. The invention as set forth in claim 1 further comprising a mini-extended centerjet nozzle body forming a first entrance end and a second exit end, said centerjet nozzle being connected to said dome portion substantially in the center of said dome portion, said mini-extended centerjet nozzle further comprising a shoulder portion formed on an exterior of said centerjet nozzle body between said first entrance end and said second exit end, said shoulder portion seats against a nozzle receptacle formed in said dome portion, said centerjet nozzle is retained within said receptacle by a removable nozzle retention means threadably engaged with said dome portion through said open pin end of said rock bit body, said nozzle is inserted into and retained within said nozzle receptacle from the inside of said chamber formed by said body, said centerjet nozzle forming a streamlined internal passage with an extended portion from a streamlined throat in said passage to said second exit end of said nozzle body, said second exit end of said centerjet nozzle body is on a plane at least even with said nozzle receptacle to substantially prevent erosion of said centerjet nozzle and receptacle during operation of said rock bit in an earth formation, said centerjet nozzle serves to clean said one or more rotary cones of detritus, prevent balling of the bit and to further entrance drill bit penetration.

3. The invention as set forth in claim 1 wherein said one or more mini-extended nozzles may be fabricated from a hard, wear resistant material, such as tungsten carbide.

4. The invention as set forth in claim 3 wherein said one or more mini-extended tungsten carbide nozzles form a taper from said streamlined nozzle throat portion to said second nozzle end.

5. The invention as set forth in claim 4 wherein said taper formed in said tungsten carbide nozzles downstream of said throat portion forms an included angle of from one to five degrees.

6. The invention as set forth in claim 5 wherein the included angle is no less than one degree.

7. The invention as set forth in claim 1 wherein said one or more mini-extended nozzles may be fabricated from alloy steel, said alloy steel nozzles form a taper from said streamlined nozzle throat portion to said second nozzle end.

8. The invention as set forth in claim 7 wherein said taper formed by said steel alloy nozzles downstream of said throat portion forms an included angle of from one to five degrees.

9. The invention as set forth in claim 8 wherein the included angle is no less than one degree.

* * * * *